US008280096B2

(12) United States Patent
Milot

(10) Patent No.: US 8,280,096 B2
(45) Date of Patent: Oct. 2, 2012

(54) ELECTRODYNAMIC TRANSDUCER, IN PARTICULAR OF THE LOUDSPEAKER TYPE WITH FERROFLUID SUSPENSION AND RELATED DEVICES

(76) Inventor: Gilles Milot, Mayet (FR)

( * ) Notice: Subject to any disclaimer, the term of this patent is extended or adjusted under 35 U.S.C. 154(b) by 488 days.

(21) Appl. No.: 12/672,926

(22) PCT Filed: Aug. 7, 2008

(86) PCT No.: PCT/FR2008/051478

§ 371 (c)(1),
(2), (4) Date: Feb. 10, 2010

(87) PCT Pub. No.: WO2009/022085

PCT Pub. Date: Feb. 19, 2009

(65) Prior Publication Data

US 2011/0188698 A1 Aug. 4, 2011

(30) Foreign Application Priority Data

Aug. 9, 2007 (FR) ..... 07 57017

(51) Int. Cl.
*H04R 9/02* (2006.01)

(52) U.S. Cl. ..... 381/398; 381/412; 381/415

(58) Field of Classification Search ..... 381/415, 381/396, 412, 398

See application file for complete search history.

(56) References Cited

U.S. PATENT DOCUMENTS

| | | | | |
|---|---|---|---|---|
| 5,335,287 | A | 8/1994 | Athanas | |
| 2007/0189577 | A1 * | 8/2007 | Tsuda et al. | 381/415 |

FOREIGN PATENT DOCUMENTS

| | | | |
|---|---|---|---|
| EP | 1 274 275 | A1 | 1/2003 |
| FR | 2 892 886 | A1 | 5/2007 |
| FR | 2 892 887 | A1 | 5/2007 |
| GB | 1 599 506 | A | 10/1981 |
| WO | WO 96/13960 | | 5/1996 |

OTHER PUBLICATIONS

International Search Report, dated Feb. 3, 2009, from corresponding PCT application.

* cited by examiner

*Primary Examiner* — Yuwen Pan
*Assistant Examiner* — Phan Le
(74) *Attorney, Agent, or Firm* — Young & Thompson

(57) ABSTRACT

An electrodynamic transducer with a membrane includes an electrodynamic motor in a carcass in which a coil held by a mandrel connected to the membrane is capable of movement. The mandrel has a shape generated by an essentially linear generatrix, the coil being arranged in an air gap of a vertical free space where it is capable of movement and defined, towards the center of the transducer, by an inner magnetic structure and, towards the periphery of the transducer, by an outer magnetic structure, at least one of the magnetic structures generating a static magnetic field, wherein the transducer does not include any peripheral nor inner suspension and the guiding of the mobile equipment and the pneumatic tightness between the front and rear faces of the membrane being ensured by a ferrofluid. The mandrel is maintained in the air gap by the ferrofluid applied on at least one of the two faces of the mandrel and entirely filling the air gap.

18 Claims, 3 Drawing Sheets

Figure 1:
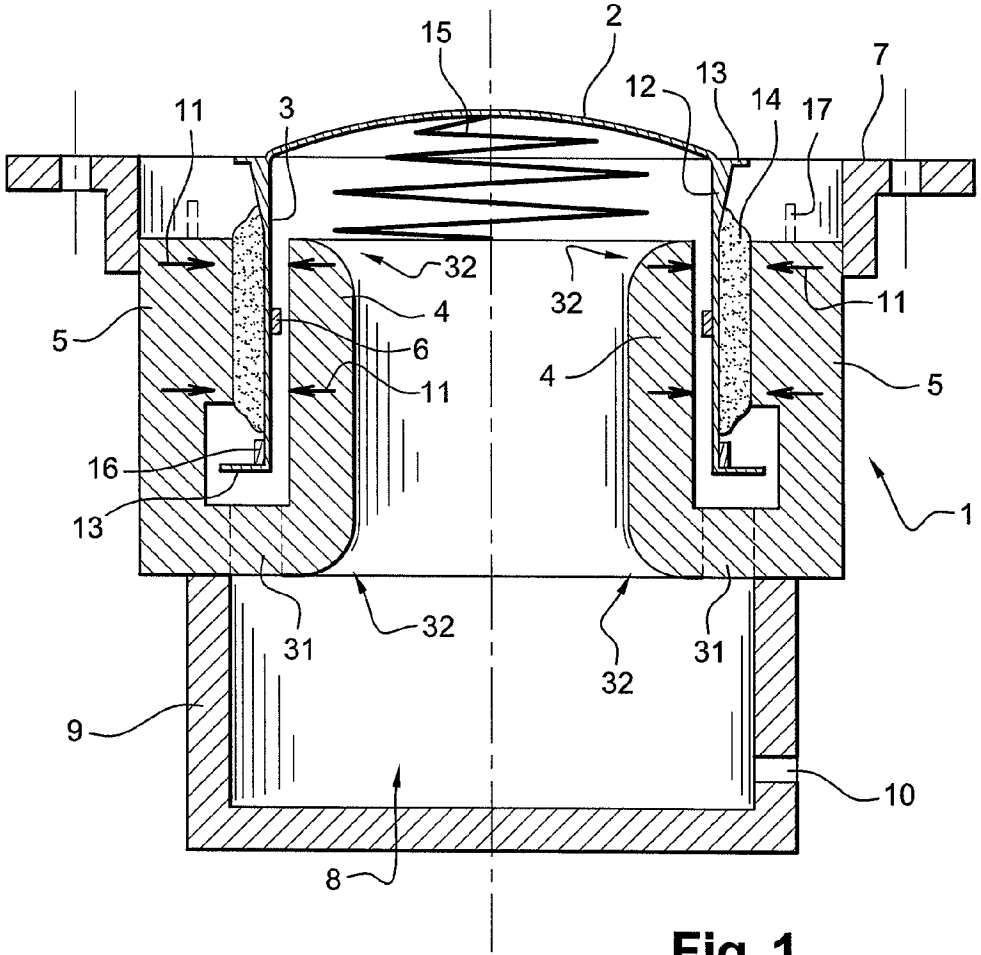

ELECTRODYNAMIC TRANSDUCER, IN PARTICULAR OF THE LOUDSPEAKER TYPE WITH FERROFLUID SUSPENSION AND RELATED DEVICES

The present invention relates to the field of moving-coil electrodynamic transducers, in particular loudspeakers, with no mechanical suspension but with a ferrofluid suspension. It finds applications in the field of the manufacturing of measuring instruments: in particular for sound pick-up, for vibration measurements, as well as devices for sound reproduction, in particular loudspeakers.

It is already known through FR05/53330 (FR-2,892,887) a transducer of the loudspeaker type with non mechanical suspension between the coil-supporting mandrel or the diaphragm and the frame, the guidance of the mandrel being provided by at least two ferrofluidic seals, one of which is continuous to ensure an acoustic sealing between the two faces of the diaphragm. It has also been shown in FR05/53331 (FR-2,892,886) that an ironless motor may be used with a ferrofluid.

Conventionally, a moving-coil electrodynamic loudspeaker comprises a diaphragm integral with a coil-supporting mandrel, the coil being plunged in a magnetic field of an air gap. The air gap is a narrowed area of a vertical free space of the loudspeaker's electrodynamic motor, in which the coil supported by the mandrel is movingly arranged. When it is traversed by a variable current, the coil moves in the magnetic field that is generated by a magnetic-field generator of the permanent-magnet type.

Although the means disclosed in FR05/53330 and FR05/53331 provide loudspeakers with a relatively simple structure and with good performances with respect to their volume, it appears that their operation could still be improved and that the implemented techniques could be extended to various types of loudspeakers.

Amongst the means improving the operation of transducers, in particular loudspeakers, with no mechanical suspension (no peripheral suspension between the diaphragm periphery and the frame, and no internal suspension between the diaphragm or the mandrel and the frame), but with a ferrofluid suspension (the moving mandrel supporting the coil and integral with the diaphragm being held and guided in the air gap by ferrofluid), the ferrofluid is spread on at least one of the two faces of the mandrel and completely fills the air gap. Preferably, the ferrofluid even overflows from the air gap so that, during translational movements of the mandrel within the air gap, the latter is always full of ferrofluid on the corresponding face(s) of the mandrel. Besides this full filling of the air gap, the ferrofluidic seal is continuous over the circumference of the mandrel and forms a sealing means between the front and rear faces of the diaphragm. If the ferrofluid can be held in the air gap by the presence of one or more magnetic field(s) that (is) are more concentrated therein, it is also possible to further provide or rely on magnetic-field confining means, in particular toward the ends of the air gap (or even outside the vertical free space for the ferrofluid overflowing from the air gap), so as to better retain the ferrofluid within the air gap. Indeed, besides specific magnetic-field confining means that can be made, the ends/edges of magnets (ironless motor) or of pole pieces (conventional iron motor) are areas in which a field confinement is produced, which corresponds to a magnetic-field confining means. Indeed, the ferrofluid tends to come where the magnetic field and/or the magnetic-field variation are the highest.

Such a structure may be utilized in transducers of the microphone type or loudspeaker type. As for the latter type, it applies both to the dome or the cone loudspeakers.

Accordingly, the invention relates to a diaphragm electrodynamic transducer comprising an electrodynamic motor in a frame and in which can move a moving coil fastened to a mandrel integral with the diaphragm, the mandrel and the moving coil and the diaphragm forming a moving unit (the mandrel is a shape generated by a generally linear generatrix), the moving coil being arranged in an air gap of a vertical free space in which it can move and which is delimited, toward the transducers centre, by an internal magnetic structure, and toward the transducer's periphery by an external magnetic structure, at least one of the magnetic structures generating a static magnetic field, the transducer comprising no peripheral suspension and no internal suspension, the peripheral suspension being a suspension between the diaphragm's periphery and the frame, the internal suspension being a suspension between the diaphragm or the mandrel and the frame, the guidance of the coil and the pneumatic sealing between the front and rear faces of the diaphragm being provided by a ferrofluid.

According to the invention, the mandrel is held in the air gap by a ferrofluid spread on at least one of the two faces of the mandrel and that completely fills the air gap.

Because the ferrofluid fully fills the air gap, i.e. both over the height and over the circumference of the mandrel, it can be noticed that sealing is provided between front and rear of the mandrel. Sealing may be essential between front and rear of the diaphragm and thus, in some types of transducers, the spread ferrofluid, due to its additional sealing function, offers an advantage. It is to be pointed out that the term "seal" is considered in the present context in the meaning of "linking" (a face of the mandrel to the adjacent face of the vertical free space, in particular the air gap). Therefore, a ferrofluidic seal can provide or not a pneumatic sealing between front and rear of the mandrel for the corresponding face according to the shape thereof: continuous seal over the circumference of the mandrel (as the seal that completely fills the air gap or as a low-height seal continuous over the circumference) or discontinuous seal (as the vertical discrete seals spread over the whole height of the air gap, or even overflowing therefrom). It is also to be noted that the term "air gap" is used to refer to a particular area of the vertical free space (vertical with respect to a motor representation whose cylindrical symmetry axis is vertical), in which the mandrel can move in translation (excursion), this area is the one in which one or more substantially radial magnetic field(s) are created and concentrated to act on the moving coil. This area is in connection with one or more magnetic structure(s) generating static magnetic field(s) or for guiding field(s), with or without iron according to the type of motor that is chosen: iron motor or ironless motor. Therefore, the term "air gap" does not impose the presence of iron (or another ferromagnetic material) for guiding the magnetic field in connection with said air gap. It is also to be noted that each motor comprises two magnetic structures (internal and external with respect to the mandrel), wherein at least one of the two comprises at least one means for generating one or more magnetic field(s) (especially magnet(s)) and wherein the other may comprise one or more such magnetic-field generating means or a part for looping the magnetic field (a ferromagnetic part, for example, as in the case of a conventional iron motor) or a part that is neutral with respect to the magnetic field (a frame part made of plastic, for example), or else it may be air (absence of actual physical element).

In various embodiments of the invention, the following means may be implemented, either alone or in any technically possible combination:

preferably, the spread ferrofluid, which completely fills the air gap, is spread on only one of the two faces of the mandrel (there may be ferrofluid or not on the other face and, in case there is, the ferrofluid preferably not completely fills the air gap: it may be continuous or discontinuous (=discrete), including vertically spread discrete seals), the transducer is a microphone or geophone, the transducer is a loudspeaker, ferrofluid is utilized on each of the two faces of the mandrel (including a spread seal, which completely fills the air gap), the mandrel is pierced and the ferrofluid is placed on each side of said mandrel and can pass trough said mandrel, the ferrofluid overflows from the two ends of the air gap, so that, during excursions of the mandrel in the air gap, the latter is always filled with ferrofluid on the corresponding face(s) of the mandrel, the transducer comprises means for fluidic return and braking of the moving unit to an equilibrium position, said fluidic return/braking means generating a preferably progressive diminution of the space in which the ferrofluid can move during excursions of the moving unit out of its equilibrium position, said fluidic return/braking means being chosen from at least one of the following means and the combinations thereof:

an upper and/or lower conicity (with respect to the coil) of the mandrel on the ferrofluid side, at least one upper and/or lower protrusion pattern (with respect to the coil) of the mandrel on the ferrofluid side, at least one concavity of the mandrel, the concavity of the mandrel is axially elongated and comprises front and rear ends (on both sides of the coil), having a depth that is more reduced than toward its centre (in the longitudinal direction), the concavity of the axially elongated mandrel has a substantially constant depth in the area of the air gap (the area of the mandrel in the air gap when the mandrel is at rest), the concavity of the axially elongated mandrel overflows forward and rearward from the air gap (with respect to the coil), the mandrel comprises a set of axially elongated concavities, the return (or braking) force generated by the fluidic return/braking means is proportional to the excursion, the return (or braking) forces generated by the fluidic return/braking means for the two directions of excursion with respect to the equilibrium position of the moving unit are symmetric to each other (curves of variation of the force versus excursion with respect to the equilibrium/rest position, wherein this arrangement is preferably obtained through fluidic return/braking means that are similar but symmetric to each other, on either side of the coil), the protrusion pattern is substantially triangular with the tip oriented toward the ferrofluid (and thus toward the air gap) and the base oriented toward the mandrel end (and thus on the opposite side from the air gap), the sides between the tip and base of the protrusion pattern are straight, the sides between the tip and base of the protrusion pattern are curved, the thickness of the protrusions is constant, the thickness of the protrusions increases toward the end of the mandrel, the maximum thickness of the conicity or of the protrusions is such that the conicity or the protrusions can pass in the air gap, the maximum thickness of the conicity or of the protrusions is such that the terminal parts thereof toward the end of the mandrel can not pass in the air gap (forming, furthermore, one or several stops), at rest (with the moving unit at the equilibrium position), the fluidic return/braking means is/are already positioned partially in the ferrofluid (so that the fluidic return/braking forces of said means act even at rest), at rest (with the moving unit at the equilibrium position), the fluidic return/braking means is/are positioned at a determined distance from the ferrofluid limit, outside of the ferrofluid (so that any fluidic return/braking force of said means begins to act only after a certain beginning of excursion), preferably, at rest (with the moving unit at the equilibrium position), the fluidic return/braking means is/are positioned at the ferrofluid limit (so that any fluidic return/braking force of said means begins to act only when excursions begin), the corresponding wall of the air gap or of the adjacent vertical free space comprises, toward its ends, relief patterns oriented toward the mandrel (protrusions) in connection with the spaces between the protrusion patters of the mandrel (it may allow to limit the possibilities of rotation of the mandrel around itself, the protrusions of the mandrel and of the vertical free space engaging with each other, with or without contact, the ferrofluid preferably limiting the engagement), the relief patterns, oriented toward the mandrel, of the corresponding wall of the air gap or of the adjacent vertical free space are further complementary in shape with respect to the spaces between the protrusion patterns of the mandrel (the engagement is all the more greater than the shapes are complementary with each other), the conicity and the upper and/or lower end pattern(s) of the mandrel on the ferrofluid side are made of a material or covered with a material that is not wettable by the ferrofluid, the conicity and the upper and/or lower end pattern(s) of the mandrel on the ferrofluid side are made of a material or covered with a material that is wettable by the ferrofluid, the transducer comprises a flange on at least one of the two ends of the mandrel (besides a ferrofluid-retaining function, if there is ferrofluid on the flange side, the flange can also ensure a stop function during the excessive excursions because ferrofluid may come into abutment against said flange if it is on the ferrofluid side, or possibly, in abutment against an edge of the air gap or of the vertical free space in the absence of ferrofluid), the transducer comprises a ferrofluid-retaining means on at least one of the two ends of the mandrel, said ferrofluid-retaining means being a flange for keeping the ferrofluid on the mandrel side, where it is initially located, during excessive excursions of said mandrel, the width of the flange is such that it can pass in the air gap (it allows to make a mandrel with flanges and to insert afterwards into the vertical free space), the width of the flange is such that it can not pass in the air gap and forms a stop during excessive excursions of said mandrel (a mechanical stop in the absence of ferrofluid on the flange side or a fluidic stop in the presence of ferrofluid, because the ferrofluid may come into abutment against said flange during excessive excursions), the flange is a part added on the mandrel (it may be mounted once the mandrel is placed in the air gap, which is useful when the flange can not pass in the air gap due to its width), the flange is a flat part, the flange is L-shaped (L-return toward the air gap side), the transducer comprises at least two magnetic-field confining means in the vertical free space, the confining means being stepped in the vertical free space, the at least two magnetic-field confining means are located at the air gap, the mandrel comprises concave deformations having determined shapes, in which the ferrofluid forms a protrusion with respect to the rest of the mandrel, the transducer further comprises at least one non-fluidic return means of the moving unit (but still no mechanical suspension), the non-fluidic return means of the moving unit is chosen from one or more of the following means:

loading of the diaphragm with a closed volume at the rear the dome, the internal magnetic structure being open toward said closed volume;

loading of the diaphragm with a closed volume at the rear the dome, the internal magnetic structure being open toward said closed volume, which comprises a device for controlling the inner pressure, in particular through controlling the temperature of the air contained in the closed volume;

loading of the diaphragm with an almost-closed volume at the rear the dome, the internal magnetic structure being open toward said almost-closed volume, said almost-closed volume having a minimal pneumatic leakage, the time constant of which is very long with respect to the frequencies to be reproduced, said leakage being notably in the form of a porous material or a very small diameter orifice or a thin tube toward the outside of the transducer;

a mechanical return means of the spring or elastic material type between the dome or the mandrel and a fixed part of the transducer;

an electronic feedback control of the coil position;

a configuration of the coil and the internal and external magnetic structures such that a return force is electromagnetically exerted onto the coil;

a configuration of the moving unit and the internal and external magnetic structures such that a return force is magnetically exerted onto said moving unit (especially by placing (fixing) small-size magnets (notably micro-magnets) onto the mandrel, preferably such micro-magnets are arranged opposite (at the same height, with the moving unit at rest) one (or several) magnetic-structure ferromagnetic ring(s) of the motor, which further allows to improve the alignment);

a set of small-size magnets (such a size that they do not hamper the excursions of the mandrel in the air gap) is fixed on the mandrel (for example, equiangular distribution of these magnets along the circumference of the mandrel), the transducer further comprises at least another moving-unit return means (but still no mechanical suspension), chosen from one or more of the following means:

a deformation of the mandrel in the ferrofluid area or outside this area, said deformation extending along the perimeter of the mandrel being defined so as to create a return force proportional to the displacement of the moving unit when ferrofluid is present at this place;

furthermore, utilization of segments of vertical ferrofluid seals, each segment of vertical seal being in connection with a deformation along a segment of the vertical generatrix of the mandrel, the vertical deformations being defined so as to create a return force proportional to the displacement of the moving unit;

one or more deformations in an area of ferrofluid seals, in particular deformations along segments of vertical generatrices of the mandrel, said deformations being defined so as to create a return force proportional to the displacement of the moving unit, the internal magnetic structure comprises at least one magnet, the external magnetic structure comprises at least one magnet, the motor is an iron motor, with a ferromagnetic element looping the magnetic field outside the air gap, the motor is an ironless motor, wherein the magnetic field is looped outside the air gap, in the air, the motor is an ironless motor, wherein the magnetic field is looped outside the air gap, in a non ferromagnetic material, the motor is an ironless motor, wherein the magnetic field is looped outside the air gap, in magnets, the transducer is a loudspeaker, the diaphragm is a dome (the diaphragm is located toward the centre of the loudspeaker: one pneumatic seal is sufficient), the transducer is a loudspeaker, the diaphragm is a cone (the diaphragm is located outward the centre of the loudspeaker: two pneumatic seals are needed at the two circumferential ends, toward the centre and toward the outside, of the diaphragm), the transducer is a loudspeaker, the diaphragm comprises a dome part and a cone part (one pneumatic seal may be sufficient toward the outside of the diaphragm of the cone part), the transducer is a loudspeaker, the diaphragm is a cone, said diaphragm being located outward the centre of the loudspeaker and a continuous ferrofluid seal (for a pneumatic sealing) being further arranged along the circumference of an edge of the diaphragm, said edge being located along the rim of the diaphragm that is opposed to the rim of the diaphragm in connection with the mandrel, said ferrofluid seal being held by a magnetic-field confining means, the edge comprises a fluidic retaining and return/braking means (it is therefore a fluidic means for returning the diaphragm to an equilibrium position, which ensures a return of the diaphragm to an equilibrium position for the corresponding rim of the diaphragm) in the form of a curve such that, when the diaphragm is a its rest position (of static equilibrium), the ferrofluid seal has a maximum space where to position itself with respect to excursions out of the rest position, the diaphragm comprises a dome-type part and another part of the cone type, the moving coil is an electrically short-circuited turn and at least one of the magnetic structures comprises a fixed coil intended to receive a modulation current, the fixed coil being placed at the air gap in the magnetic structure, the motor comprises only one fixed coil, the motor comprises two fixed coils, one in each of the magnetic structures, the electrically short-circuited turn type moving coil is integrated to the mandrel, the mandrel being metallic and electrically conductive and forming said electrically short-circuited turn.

The invention also relates to a fluidic return/braking device for a moving coil of a diaphragm electrodynamic transducer comprising an electrodynamic motor in a frame and in which can move the coil supported by a mandrel integral with the diaphragm, the coil being arranged in an air gap of a vertical free space in which it can move and which is delimited, toward the transducers centre, by an internal magnetic structure, and toward the transducer's periphery by an external magnetic structure, at least one of the magnetic structures generating a static magnetic field, the transducer comprising no peripheral suspension and no internal suspension, the peripheral suspension being a suspension between the diaphragm's periphery and the frame, the internal suspension being a suspension between the diaphragm or the mandrel and the frame, the guidance of the moving unit and the pneumatic sealing between the front and rear faces of the diaphragm being provided by a ferrofluid.

The fluidic return/braking device is characterized by a structure in relief of the mandrel, which can pass at least partially in a reduced cross-section portion of the vertical free space (and in particular in the air gap, which is vertical too) during excursions of the moving unit, and which, during these excursions, progressively reduces the space where the ferrofluid may position itself, said structure being chosen, alone or in combination, from conicity or relief patterns at the upper and/or lower ends of the mandrel (in practice, at any position on the mandrel that is suitable for the intended function), on the ferrofluid side.

Preferably, the fluidic return/braking device is especially adapted to the transducer according to one or more of the embodiments described, wherein the ferrofluid completely fills the air gap, or even overflows therefrom.

The invention also relates to a ferrofluid-retaining and/or stop device (excursion limiting device, of the mechanical or fluidic type according to the absence or the presence of ferrofluid) for a diaphragm electrodynamic transducer comprising an electrodynamic motor in a frame and in which can move the coil supported by a mandrel integral with the diaphragm, the coil being arranged in an air gap of a vertical free space in which it can move and which is delimited, toward the transducers centre, by an internal magnetic structure, and toward the transducer's periphery by an external magnetic structure, at least one of the magnetic structures generating a static magnetic field, the transducer comprising no peripheral suspension and no internal suspension, the peripheral suspension being a suspension between the diaphragm's periphery and the frame, the internal suspension being a suspension between the diaphragm or the mandrel and the frame, the guidance of the moving unit and the pneumatic sealing between the front and rear faces of the diaphragm being provided by a ferrofluid.

The ferrofluid-retaining device is characterized in that it is a flange arranged toward at least one of the two ends of the mandrel (in practice, at any position on the mandrel that is suitable for the intended function), in lateral projection from said mandrel, at least on the mandrel side on which is located the ferrofluid, and intended to retain the ferrofluid on said side during excessive excursions of the moving unit.

Preferably, the ferrofluid-retaining device is especially adapted to the transducer according to one or more of the embodiments described, wherein the ferrofluid completely fills the air gap, or even overflows therefrom.

The invention also relates to an eddy current motor for a diaphragm electrodynamic transducer in which can move the coil supported by a mandrel integral with the diaphragm, the mandrel being a shape generated by a generally linear generatrix, the coil being arranged in an air gap of a vertical free space in which it can move and which is delimited, toward the transducer's centre, by an internal magnetic structure, and toward the transducer's periphery by an external magnetic structure, at least one of the magnetic structures generating a static magnetic field.

The eddy current (iron or ironless) motor is characterized in that it comprises, in at least one of the magnetic structures, a fixed coil (there may be one fixed coil in the internal magnetic structure and one another in the external structure) intended to receive a modulation current, the fixed coil being placed at the air gap in the magnetic structure, and in that the moving coil is an electrically short-circuited turn.

In an alternative embodiment of the eddy current motor, the electrically short-circuited turn type moving coil is integrated to the mandrel, the mandrel being metallic and electrically conductive and forming said electrically short-circuited turn.

Preferably, the eddy current motor is an ironless motor.

Preferably, the eddy current motor is especially adapted to the transducer according to one or more of the embodiments described, said transducer comprising no peripheral suspension and no internal suspension, the peripheral suspension being a suspension between the diaphragm's periphery and the frame, the internal suspension being a suspension between the diaphragm or the mandrel and the frame, the guidance of the moving unit and the pneumatic sealing between the front and rear faces of the diaphragm being provided by a ferrofluid, more particularly, the mandrel being held in the air gap by a ferrofluid spread on at least one of the two faces of the mandrel and that completely fills the air gap.

It is to be noticed that a loudspeaker intended to rather produce the low frequencies of the audible spectrum must generally have a large excursion so as to be able to produce a sufficient acoustic energy and that a loudspeaker intended to rather produce the high frequencies of the audible spectrum does not need such a large excursion. According to the invention, a dome loudspeaker for low frequencies can be made, which can be relatively compact-size thanks to a large excursion.

Figure 2:
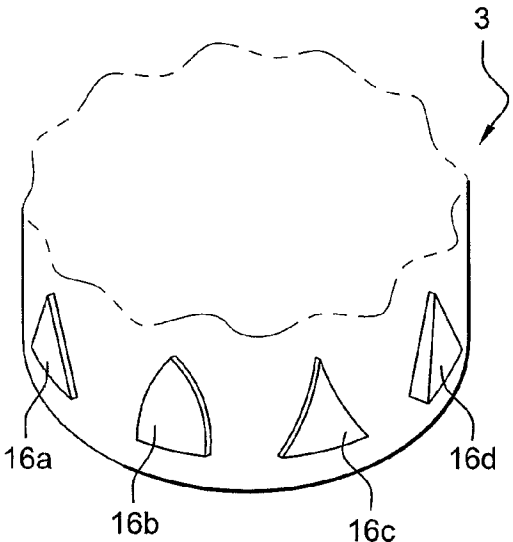
Figure 3:
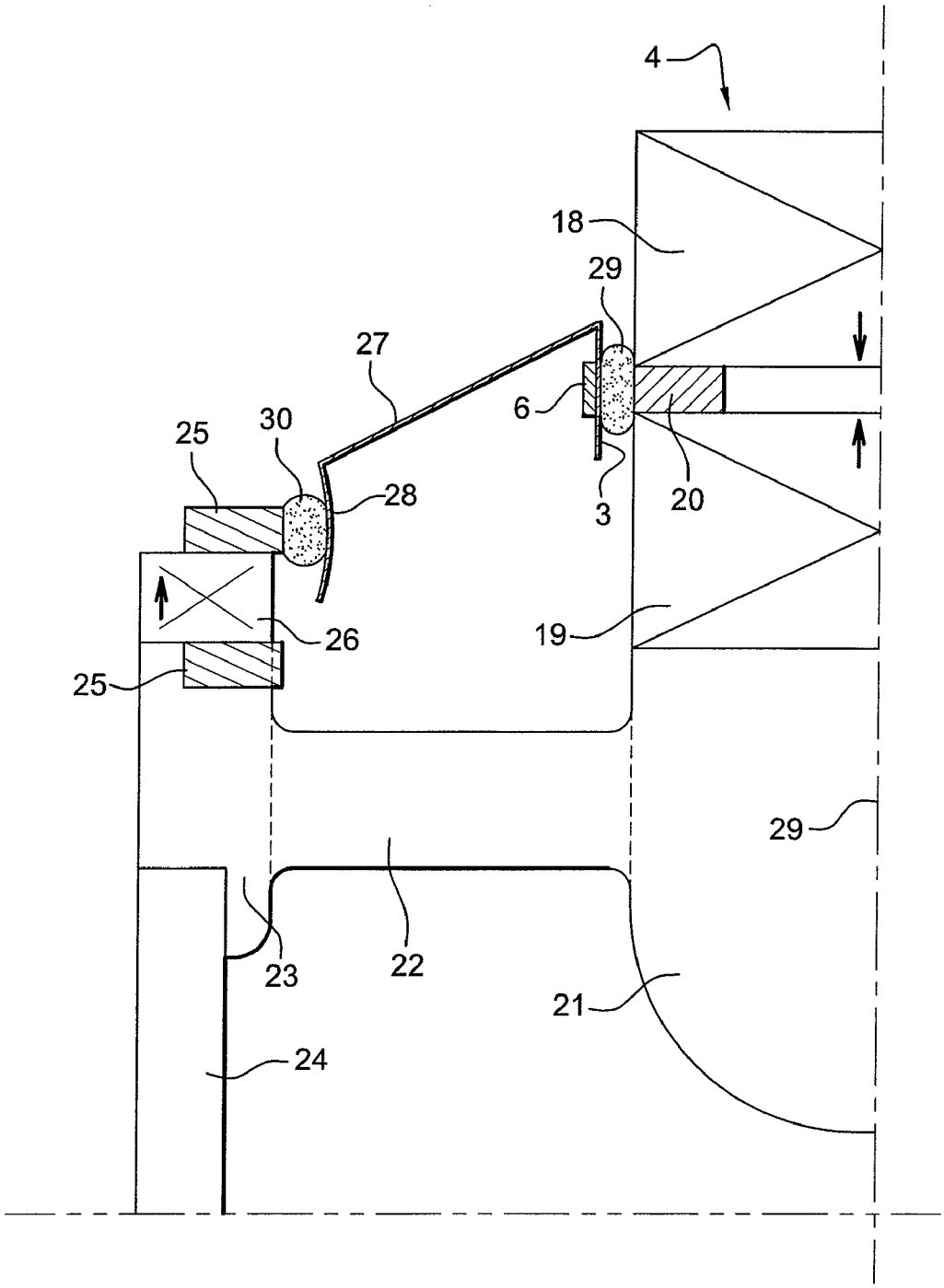
Figure 4:
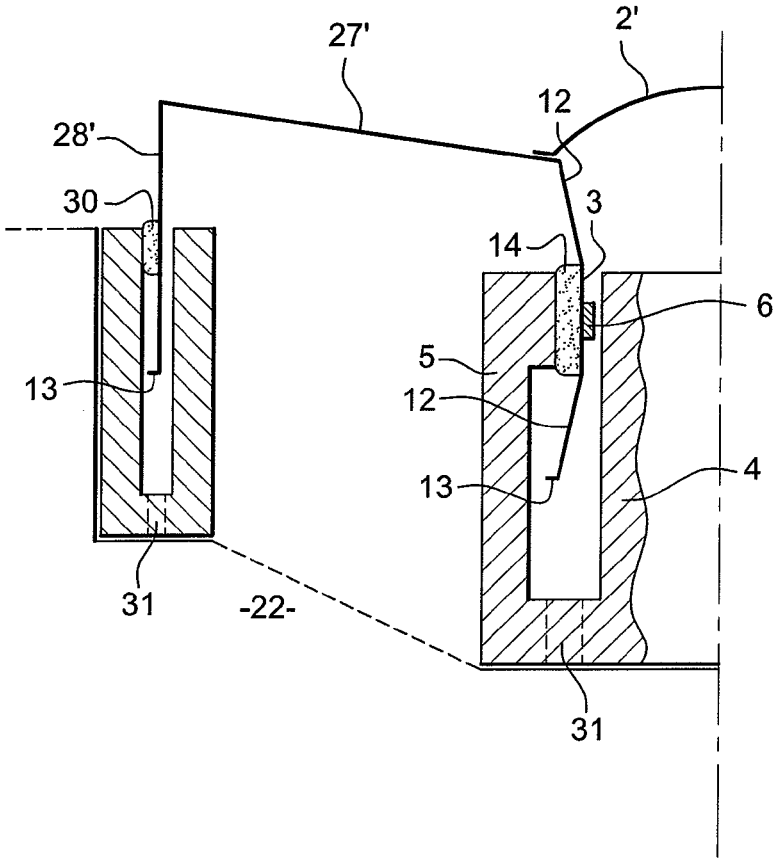
Figure 5:
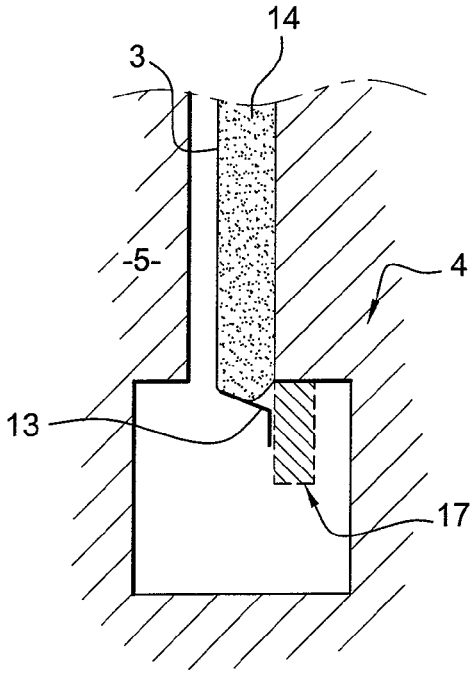

The present invention will now be exemplified, without thereby being limited, by the following description of embodiments, with reference to the appended drawings, in which:

FIG. 1 illustrates a vertical cross-section passing through the anteroposterior axis of circular symmetry of a dome loudspeaker, with alternative embodiments of fluidic return/braking means and ferrofluid-retaining/stop means, as well as a non fluidic return means for the moving unit, FIG. 2 illustrates several examples of projection-type fluidic return/braking means, shown at one of the two ends of a mandrel, FIG. 3 illustrates a vertical cross-section passing through the anteroposterior axis of symmetry of a cone loudspeaker, schematically showing two embodiments of a motor, the first one with a conventional moving coil traversed by a modulation current and the second one with a moving coil which is an electric short-circuited turn, the modulation current being sent to a fixed coil arranged in the air gap, FIG. 4 illustrates a vertical cross-section passing through the anteroposterior axis of circular symmetry of a dual loudspeaker, comprising a dome-type diaphragm part and another part of the cone type, and with, on the inner side of the cone and on the motor side, fluidic return/braking and ferrofluid-retaining/stop means, and, on the external side of the cone, a fluidic guiding means with magnetic-field confining means, FIG. 5 illustrates a simplified enlargement of a posterior (lower) end of an air gap, with an L-shaped flange and an optional wall.

In the following description, it will be more particularly referred to transducers of loudspeaker type, although the means of the invention may apply to other types of devices and especially microphones or geophones, provided that these devices are of the electrodynamic type with a moving coil.

The ferrofluid-suspension loudspeakers considered by way of example are dome-type or cone-type or mixed (dome+cone) loudspeakers.

The dome loudspeakers have a central diaphragm and only one pneumatic sealing ferrofluid seal, that is continuous along the peripheral circumference of the mandrel, is sufficient to provide a pneumatic insulation between the two faces of the diaphragm. The seal may be a single seal and, preferably, may spread over the whole height of the air gap (on at least one of the faces of the mandrel, the air gap being completely filled with ferrofluid) or may be associated to one or several other ferrofluid seals located on the other face of the mandrel (for example: another seal, on the other face of the mandrel, spread over the whole height of the air gap). Besides the continuous seal spread in height in the air gap, the possible other ferrofluid seal(s) may be stepped and/or be of any shape(s), including vertical seals.

The cone loudspeakers have a lateral diaphragm and at least two ferrofluid seals, including two pneumatic seal continuous along the two peripheral inner ant outer circumferences of the diaphragm (in practice, along the circumference of the mandrel and the circumference of an edge of the diaphragm), are utilized to ensure the pneumatic insulation between the two faces of the diaphragm. On the mandrel side, there may be a single ferrofluid seal and, preferably, this seal may spread over the whole height of the air gap (on at least one of the faces of the mandrel, the air gap being completely filled with ferrofluid) or may be associated with one or several other ferrofluid seals on the other face of the mandrel (the other ferrofluid seal(s) may be stepped and/or be of any shape(s), including vertical seals).

Finally, the mixed loudspeakers, which have a diaphragm part of the cone type and another part of the dome type, are close to the dome-type loudspeakers in that only one pneumatic sealing ferrofluid seal continuous along the external peripheral circumference of the cone part of the diaphragm may be sufficient to provide the pneumatic insulation between the two faces of the diaphragm.

In any case, the means for generating the magnetic field in the air gap, even if they are preferably of the ironless-motor type, may also be more conventional and of the iron-motor type.

It is to be noted that, in the case of the cone-type or mixed loudspeakers, two motors (including two mandrels and two conventional and/or eddy current moving coils) may by utilized, and then a first magnetic-field generation means for a first air gap of a first motor is located on the inner periphery side of the diaphragm (the cone part in the mixed case) and a second magnetic-field generation means for a second air gap of a second motor is located on the outer periphery side of the diaphragm.

In an ironless motor, if the magnetic field has to be looped outside the air gap, the looping is made by magnets. In the other cases of ironless motor, the looping of the field is made (generally outside the air gap) either in the air, either through pieces that do not guide the magnetic field. Thus, in an ironless motor, this is one or several magnets that ensure the creation of the magnetic field and that can also ensure the guidance of the static magnetic field (with one or several directions of magnetic field in the air gap).

In the iron motor, a ferromagnetic body is used for guiding the magnetic field. It is to be noted that, in an ironless motor, polar pieces of small size may be utilized, but, in this case, they essentially serve to create magnetic-field confining areas in which the ferrofluid can preferably concentrate.

The motor comprises a magnetic-field generator in at least one of its two (internal and external) magnetic structures. The magnetic-field generator may comprise several magnets for the creation of at least one magnetic-field area in the air gap. In alternative embodiments, the air gap comprises three areas of field direction, with one median area in a direction and two end areas in the other direction. In the latter case, it may be utilized only one coil, the coil at rest being located in the median area (which corresponds to an end electromagnetic braking configuration because of the field inversion at the two ends of the air gap, the braking being effective during extremes excursions, and the response having to be substantially linear during normal excursions). Still in this latter case, several coils having a direction adapted to the considered field area may be utilized so as their effects are added. The magnet(s) utilized in the magnetic-field generator can be made single-piece and/or be each made of smaller magnet assemblies. In the case where each of the internal and external magnetic structures (with respect to the coil) comprises one/several magnetic-field generators, which are arranged so as to optimize the distribution and the intensity of the magnetic field area(s) in the air gap.

Preferably, the motor(s) utilized is of an end electromagnetic braking configuration.

In the air gap, the magnetic field (at least one of the field directions in the case where there are several areas of field direction) may be substantially uniform along the height of the air gap or may comprise magnetic-field reinforcement areas (or areas of large variations of the magnetic field), where the ferrofluid will preferably position itself if it is present in reduced quantity.

It is to be noticed that, if one/several magnetic-field reinforcement areas exist, which can be sites for the formation of the same number of ferrofluid seals in the air gap, the ferrofluid, if introduced in great quantity, will end up completely filling the air gap, and even overflowing therefrom. Thus, in a motor having at least two magnetic-field confining means, there will be formed on a face of the mandrel where it is introduced, and according to the quantity of ferrofluid that is introduced, two seals and then only one when the quantity introduced is increased (the two ferrofluid seals ending up merging). Conversely, it is possible, when progressively removing the ferrofluid, to leave only one/several individualized seals in the field reinforcement (confining) areas.

As an indication regarding the ironless motors and the ferrofluid suspensions, it may be referred to the above-mentioned FR05/53330 and FR05/53331.

In an alternative embodiment operating with eddy current, a fixed coil receiving a modulation current is arranged in a magnetic structure having a magnetic-field generator, the moving coil being then an electric short-circuited turn and, preferably, an electrically conductive metallic mandrel (the mandrel then ensures its mandrel function and, in addition, the function of the moving coil, which is an electric short-circuited turn).

Preferably, in the case of a spread seal, which completely fills the air gap, the ferrofluid overflows from the air gap on each side thereof, so that during the excursion of the mandrel, the latter always lies in the ferrofluid in the area where it is in the air gap. Indeed, for better results, it is preferable that the air does not enter in the area of the air gap and that there is no air entrapped in the spread ferrofluid seal completely filling the air gap.

Besides, in particular in the case where one (or several) seals are spread over the whole height of the air gap, whether it completely fills the air gap (it is circularly spread) or not (the case of discrete seals vertically spread over the whole height of the air gap), so as to obtain a effect of fluidic return to an equilibrium position of the moving unit and of fluidic braking during excursions, the upper and lower ends of the mandrel (in practice, at any position on the mandrel that is suitable for the intended function of reduction of the space where the ferrofluid can position itself) may be cone-shaped (flared) on the seal side so that, during excursions, the air gap space (or the adjacent vertical free space) between the wall of said air gap (or the adjacent wall of said vertical free space) and that of the mandrel is progressively reduced, thus reducing the space where the ferrofluid can position itself, which leads, besides a "fluidic" braking, to the creation of a force for returning the mandrel and thus the moving unit to an equilibrium position upon the suppression of the modulation current. This conical flaring may also consists of a conical protrusion of the mandrel end.

As an alternative, the mandrel may stay straight over its whole height and protrusions are then made toward the two ends of the mandrel (in practice, at any position on the mandrel that is suitable for the intended function of reduction of the space where the ferrofluid can position itself). These protrusions, whose thickness is constant or not (in particular the thickness of the protrusion progressively increases toward the end of the mandrel), have a width that progressively increases toward the end of the mandrel. By way of example, the shape of one of these protrusions is a triangle pointed toward the air gap and with the base oriented toward the mandrel end border (the upper or the lower one according to the case).

During excursions of the mandrel, these protrusions (just as the conicity) that plunge into the ferrofluid (or that are already in the ferrofluid) come in a reduced-thickness area of the air gap (or adjacent to the air gap in the vertical free space) and the ferrofluid has then less and less place where to position itself as the excursion goes along, which create a return force and a fluidic braking of the mandrel during the excursions.

Preferably, the progressive reduction of the space where the ferrofluid can position itself (tip of the conicity or of the protrusions) begins at the limit of the ferrofluid, which limit substantially corresponds to the position of the ferrofluid border when the moving unit is at rest (static equilibrium). In other words, the braking/creation of a return force begin substantially right from the start of an excursion of the moving unit. This is true for each ferrofluid limit (upper or front limit, on one hand, and lower or rear limit, on the other hand, in the figures), on either side of the air gap (overflowing ferrofluid) or at the two ends of the air gap (ferrofluid at the air gap limit), so as to obtain a return/braking effect substantially symmetrical, at least as for the beginning.

It is to be noticed that this fluidic return/braking effect by progressive reduction of the space where the ferrofluid can position itself when the excursion of the mandrel increases may also work with ferrofluid seals that do not overflow from the air gap. Indeed, the conicity and the protrusions may have a maximum thickness which allows them to pass in the air gap. In the case where this is the ends of the mandrel that have a conicity or protrusions, they may have (preferably) a maximum thickness that allows them to pass or not in the air gap, and in the latter case, they may also serve as a stop for the excessive excursions: the conicity of the mandrel or the protrusions will end up hitting the border of the air gap or of the narrowed part of the vertical free space.

Moreover, in particular in the case of seal(s) spread over the whole height of the air gap (a seal that completely fills the air gap or discrete seals) and possibly overflowing therefrom, in addition or not to the fluidic return/braking devices, the ends of the mandrel may comprise ferrofluid-retaining edges in the form of a flange (a ring or an annular collar, these terms being also equivalent), at the end border of the mandrel (in practice, at any position on the mandrel that is suitable for the intended retaining and/or stop function), preferably only on the ferrofluid side, but, in other alternative embodiments, on each side of the mandrel. These flanges allow keeping the ferrofluid on the side of the mandrel where it is normally located, and avoid it passes on the other side of the mandrel during excessive excursions. In a particular embodiment, these flanges have such a width that they can not pass in the air gap or, more generally, a reduced-width part of the vertical free space. Therefore, the flanges may further have a function of mechanical stop (they come into abutment against the border of the air gap or a part of reduced width of the vertical free space) or of fluidic stop (they come into abutment against the ferrofluid) during excessive excursions. In the case where the flanges have a width greater than the width of the air gap, it is to be understood that one of the flanges will have to be placed after the introduction of the mandrel into the air gap of the vertical free space, unless one of the walls of the air gap can be mounted during a subsequent step of fabrication of the motor. Moreover, the flange constitutes a means for reinforcing the mandrel and improves its mechanical strength (which avoids possible deformations of the mandrel, in particular crimps or the like).

The ferrofluid is especially chosen, on the one hand, for its longevity of resistance to high temperatures that can be met in loudspeakers, and on the other hand, as a function of its viscosity. By way of example, the ferrofluid APG S12n of the FERROTEC Company, United-States, may be utilized. As already said and so as to obtain better results, it is preferable that there is no air bubble or air pouch in the spread ferrofluid, which completely fills the air gap. For that purpose, it may be useful to degas the ferrofluid before it is introduced in the air gap (and, as already said, it is preferable that the ferrofluid overflows from the ends of the air gap, on both sides, so that during excursions of the mandrel, no air can penetrate in the air gap).

The electrodynamic motor of the loudspeaker 1 with a dome 2 of FIG. 1 comprises a coil 6 on a mandrel 3 and external 5 and internal 4 magnetic structures, only one of which comprises one/several magnetic-field generating means in the air gap. The coil 6 is placed in an air gap of a vertical free space in which the mandrel can move during the excursions of the moving unit. In this example, magnetic-field confining means 11 are shown and are intended to create, in the vertical free space (inside or outside the air gap), magnetic field concentrations/variations where the ferrofluid tends to preferably concentrate. These confining means are optional and the number and position(s) may be different according to the loudspeaker embodiment. Ferrofluid 14 has been introduced in the air gap, on the outer face side of the mandrel 3, so as to completely fill the air gap between the outer face of the mandrel and the external magnetic structure 5. Moreover, the quantity of ferrofluid is such that it overflows upward and downward from the air gap, so that, during excursions of the moving unit (at least of the normal excursions), the air gap is always filled with ferrofluid on the corresponding face of the mandrel 3. It is to be understood that the ferrofluid 14 spread over the whole height of the air gap and that completely fills the air gap is also spread along the whole perimeter of the mandrel, which also ensures a pneumatic/acoustic sealing between the two (front-rear) faces of the dome 2.

In an alternative embodiment, ferrofluid is also introduced on the inner face side of the mandrel, either to form one/several independent ferrofluid seals (at the field confining means) when the quantity of ferrofluid is low or to completely fill the air gap (preferably, so as to overflow therefrom), on this inner side. It is to be noticed that the possible seal(s) on the other face of the mandrel (the other face than that of the ferrofluid that completely fills the air gap) may be of various shapes and, for example, instead of horizontal, they may be vertical, oblique or of another shape, including a profiled shape (the field confining means will be accordingly adapted).

It is to be understood that the dispositions of some of the elements of FIG. 1 may be reversed, for example the ferrofluid filling the whole height of the air gap is located only on the inner side of the mandrel. It is to be noted that, since it is necessary to pneumatically insulate (sealing function) the front of the diaphragm from the rear thereof, in this case a dome 2, it will be provided that the ferrofluid that completely fills the air gap or one of the possible associated seals ensures this function in the realized structure. Indeed, the lower part of the vertical free space is not necessarily closed and may be open to free air or into a rear pneumatic load. Likewise, the position of the coil 6 (which may indeed be a set of coils) may be reversed with respect to FIG. 1 and be positioned on the outer face side of the mandrel 3.

The motor is placed in a rigid bowl, only a forward part 7 of which have been shown, with a means for the fixation to a support (screw passing orifice), which may be a face of an enclosure, for example. Besides the fact that the two external and internal magnetic structures may be both active structures (i.e. they may have magnetic-field generating means), as an alternative, one of the external 5 or internal 4 magnetic structure may be a passive structure, i.e. it comprises only means for guiding a magnetic field created in the other structure or does not comprise such means and may then be made of a neutral materiel with respect to the magnetic field, or else it may be air (absence of actual physical element).

In an alternative embodiment, the two internal and external magnetic structures may be active structure(s), i.e. they may each comprise one/several static-magnetic-field generating means (one/several magnets: ring/pellet/composite/single-unit . . . ), or else, they may be mixed, i.e. they may comprise on/several magnetic-field generating means and one/several magnetic-field guiding means. Therefore, the motor of FIG. 1 may by of the iron type or of the ironless type (with only one/several magnets).

FIG. 1 also illustrates two non-fluidic return means for returning the moving unit toward a predetermined position when the coil is no longer electrically excited (or following the suppression of an accidental external stress). These non-fluidic return means, given by way of example in the simplified FIG. 1, are, on the one hand, a pneumatic load of the dome rear face, and on the other hand, a mechanical means of the spring type. It is to be noticed that the conicity 12 and the protrusions 16 are also return means, but of the fluidic type.

The pneumatic load corresponds to utilizing a closed volume 8 at the rear the diaphragm, this volume, closed by a wall 9, is in this case almost-closed, because a minimal leakage in the form of an orifice 10 has been made. The time constant of the orifice (the time necessary to equilibrate the pressures between the two sides of the orifice) is very long with respect to the frequencies to be reproduced by the loudspeaker. The orifice has thus a very small diameter or may be replaced/supplemented by a porous material or by a thin tube (such as a capillary tube or a needle).

It can be noticed that, to load the rear of the dome with this almost-closed volume arranged essentially rear the motor, the central core of the motor is hollow toward the rear of the loudspeaker. It can be noticed, at the bottom (low part) of the vertical free space, two areas 31 delimited by dotted lines; they correspond to an alternative embodiment with a direct opening (or openings) between the bottom of the vertical free space and the closed or almost-closed rear pneumatic-load volume 8. In the absence of the opening(s) 31, the communication between the bottom of the vertical free space and the load rear volume 8 follows a path going up frontward along the mandrel and passing through the central opening of the loudspeaker. It is to be understood that the opening(s) 31 improves the functioning in case where one/several seals continuous along the circumference of the mandrel would also be utilized on the side opposed to the spread seal 14 that completely fills the air gap because, otherwise, there would then be no more communication possible between the bottom of the vertical free space and the rear load volume 8.

It is to be noticed that it is preferable, to obtain better results, that the rearward vertical free space is the most possible decompressed (role of the opening 31) toward the pneumatic load (rear closed or almost-closed volume), and thus the surface of the opening has to be maximum to improve the circulation of air. Given that the various elements of the loudspeaker have to be kept together, in this case the internal and external magnetic structures of the motor, spacers have to be placed through the circumferentially continuous opening 31, and these spacers may be fins of the type of the fins 22 that are utilized in the loudspeaker of FIG. 3 (which link other internal and external elements of the other loudspeaker).

Likewise, it is preferable to eliminate the sharp edges of the elements of the loudspeaker in the areas where there may by movements of air. It is especially why the frontward and rearward rims 32 of the internal magnetic structure 4 are rounded. These rounds are preferably the most extended possible.

The non fluidic return means is a spring 15 between the dome 2 and the central fixed part of the motor, in this case the internal magnetic structure 4. Other return means, in particular non fluidic means, may be utilized in alternative embodiments. In particular embodiments, no, only one or more that two non fluidic return means may be utilized.

Means for fluidic return/braking 12, 16 and for ferrofluid-retaining/stop 13 are utilized so as to limit the amplitude of the excursions and to avoid that they become to large, at the risk of "unfastening" the static and moving elements of the motor, which are held and guided together by fluidic means, in this case ferrofluid, wherein these fluidic guiding means does not provide by themselves a limit to the amplitude of the excursions, contrary to the conventional suspension mechanical means.

The fluidic return/braking means acts during excursions of the moving unit by causing a diminution of the space where the ferrofluid can position itself during said excursions. In the example illustrated, this action is allowed at the air gap, which is already an area with a reduced thickness, but, in alternative embodiments, one/several specific narrowing areas may be utilized at distance from the air gap and in connection with elements (in particular, conicity of the mandrel or protrusions) that will now be described.

To obtain this reduction of space where the ferrofluid can position itself, a space reduction that is preferably progressive as the amplitude of the excursion increases, it may be utilized a conicity 12 and/or protrusions 16 of/on the end of the mandrel (or at any other position that is suitable for the intended function).

In FIG. 1, the conicity 12 of the mandrel 3 has been shown at the top of said mandrel (a conicity obtained by construction of the mandrel or by an added-on piece) and protrusion patterns 16 have been shown at the bottom of the mandrel (protrusions obtained by construction of the mandrel or by added-on pieces). Various types of protrusions are illustrated in FIG. 2, viewed from the front on a lower (cut) part of the mandrel periphery. The first protrusion 16*a* is substantially triangular with the apex/tip upward, on the ferrofluid side, with the base toward the lower end of the mandrel, and with straight lateral sides (between the tip and the base). The second protrusion 16*b* is equivalent to the first one, except that the lateral sides are concave. The third protrusion 16*c* is equivalent to the first one, except that the lateral sides are convex. The first three protrusions 16*a*, 16*b*, 16*c* are constant in thickness. The fourth protrusion 16*d* has a thickness that increases toward the lower end of the mandrel and is similar to the above-mentioned conicity. This fourth protrusion 16*d* is of the type of the first one 16*a* as regard its triangular general shape but, in alternative embodiments, it could have other general shapes, including the shapes of the protrusions 16*b* and 16*c*. It is to be understood that, because of these different protrusion embodiments, the variation of the fluidic return and braking effects will be different, and the shape of the fluidic return/braking function can thus be chosen according to the type of protrusion utilized.

It is to be noted that, preferably, only one type of these shapes is utilized for protrusions on a mandrel. Likewise, it is preferable that the fluidic return/braking functions are identical at the two ends of the mandrel, which is easier if the fluidic return/braking means are identical (but symmetrical) at these two ends, either identical conicities, or identical protrusions (same number and same type). Therefore, preferably, conicities and protrusions are utilized, that allow obtaining a return force (symmetrical with respect to the rest position) that is proportional to the displacement in a linear working area of the loudspeaker and that corresponds to normal excursions. Outside these normal excursions, during extreme excursions, larger variations may be utilized, up to stop or almost-stop effects.

The ferrofluid-retaining/stop means 13 are flange-type edges arranged toward the upper and lower ends of the mandrel 3 (or at any other position that is suitable for the intended function), at least on the side of the ferrofluid that completely fills the air gap. This flange prevents the ferrofluid from passing on the other side of the mandrel (or, in this case, on the diaphragm), during excessive excursions of the moving unit. If, preferably, the flange has such a width that it can pass in the air gap (especially to simplify the assembly of the motor), in an alternative embodiment, this width may be such that it can not pass in the air gap. Besides the ferrofluid-retaining effect, a stop effect is provided, a fluidic stop effect in the case of FIG. 1, because the ferrofluid comes into abutment against this flange and remains entrapped on the corresponding side of the mandrel. It is to be noticed that, as shown in dotted lines with the reference 17 in FIG. 1, in an alternative embodiment, a "wall" may be made to prevent the ferrofluid from escaping by the sides, which could happen because it can no longer escape by passing on the other side of the mandrel (or of the diaphragm) due to the flange.

FIG. 3, which is not on scale, will now be described by way of example of a cone-type diaphragm loudspeaker 27. This loudspeaker, which has a cylindrical symmetry, comprises a motor with only one static-magnetic-field generator, herein arranged in the internal magnetic structure 4. This internal magnetic structure comprises, on an internal bowl part 21, first and second magnets 18 and 19 (pellet or ring), having vertical and opposed internal magnetic fields. These magnets, whose polar faces are opposed and of same sign, are separated by a space preferably comprising a material that is neutral with respect to the magnetic fields of the magnets, and there results that a radial field (horizontal in the figure) is created in the air gap in which a coil 6 integral with a mandrel 3, itself integral with the cone diaphragm 27, is located. Ferrofluid forming a first seal 29 is arranged in the air gap between the inner face of the mandrel and inner wall of the air gap. It is to be noticed that the air gap herein corresponds to an area located outside the internal magnetic structure 4, which is opposite the space comprised between the two magnets 18 and 19, and thus, as shown, the ferrofluid seal spreads over the whole height of the air gap and even overflows upward and downward therefrom. Moreover, the external magnetic structure is herein air (absence of actual physical element).

The looping outside the air gap of the magnetic field created by a static-magnetic-field generator in the internal magnetic structure 4 is made in the air. No "iron"-based structure is utilized, and thus the motor is ironless.

Still in FIG. 3, it can be noticed the presence, in the space separating the two magnets 18 and 19, of a fixed winding (fixed coil) 20, which is inserted therein for the operation of the loudspeaker through eddy current (inductive winding). Indeed, FIG. 3 shows two embodiments. In the first embodiment, which is conventional, the moving coil 6 is intended to receive a modulation current that will allow the excursions of the diaphragm, as driven by the mandrel integral with said moving coil, those three elements forming the moving unit. In this first embodiment, the fixed coil 20 may be omitted. In the second embodiment, corresponding to an eddy-current operation, the moving coil is an electric short-circuited turn and, preferably, corresponds to the mandrel 3 which is then metallic and electrically conductive, forming the circular electrical short-circuit. In this second embodiment, the modulation current is sent to the fixed coil 20. It is to be understood that this second embodiment of eddy-current operation may be used in any other type of loudspeaker, in particular the above-described loudspeakers described in connection with FIG. 1, and in which a fixed coil is utilized at the air gap, which receives the modulation current, and a moving coil is utilized, which is an electrically short-circuited turn and corresponds, preferably, to an electrically conductive metallic mandrel.

In another embodiment of the ironless motor type, the motor comprises an external magnetic structure also generating a magnetic field with magnets whose orientations are compatible with those of the internal magnetic structure (it may be referred to the above-mentioned FR05/53331 for examples of such motors). In an alternative embodiment, the static-magnetic-field generator is only external instead of being internal. In still another embodiment, the motor is of the conventional iron type.

Given that the diaphragm 27 is herein external, two ferrofluid seals 29 and 30, continuous over the circumference of the diaphragm, are necessary to ensure the pneumatic sealing between the two faces of the diaphragm 27. A first internal ferrofluid seal 29, already indicated, is arranged in the air gap between the inner face of the mandrel 3 and the outer face of the internal (central) magnetic structure 4 of the loudspeaker. This first seal 29, which is arranged in a field confining area, is thus continuous over the circumference of the mandrel 3. A second external ferrofluid seal 30 is arranged on the outer face side of an edge 28 of the diaphragm 27. The second ferrofluid seal 30 is held in place by a magnetic-field confining means arranged toward the outside of the edge 28 with respect of the central axis 29 of symmetry of the loudspeaker. The confining means arranged on an external part 23 of the bowl comprises a magnet 26 and two field plates 25, one on each polar face of said magnet. Therefore, the second seal is spread between a field plate 25 and the edge 28, while spreading continuously over the circumference of the edge 28. The edge 28 comprises a ferrofluid-retaining and fluidic return/braking means in the form of a curve, a concavity toward the ferrofluid, such that when the diaphragm is at its rest position, the ferrofluid seal 30 has the maximum space where to position itself. It is to be understood that, during excursions of the diaphragm 27 and thus of the edge 28, this space will be reduced, resulting in the fluidic return/braking effect.

Besides this return function of the second ferrofluid seal, it is also an external guiding structure of the moving unit, through the edge 28 of the diaphragm, which is the equivalent of the mandrel 3 of the internal guiding structure corresponding to the first ferrofluid seal. It is then to be understood that, as regard the guidance and the return of the moving unit, these external structures (which are not driving structure (they are passive) in the point of view of the excursions of the moving unit, and which comprise magnetic-field confining means) and internal structures (the motor itself, considered as ensuring the excursions of the moving unit and having magnetic-field generating magnetic structure(s) and an air gap) are equivalent: they comprise (at least) one magnetic-field concentration area (air gap of the motor or magnetic-field confining means), ferrofluid and one part integral with the diaphragm (edge 28, 28' or mandrel 3). There results that the moving unit may comprise, in addition to a mandrel, a diaphragm edge 28, 28'.

The inner part 21 and the external part 23 of the bowl are held together by a series of fins 22 distributed over the circumference of the loudspeaker. In the considered example, 6 fins of defined thickness are distributed over the 360° of the circumference. It can be noticed that, on the loudspeakers rear, all the elements of which have not been shown for simplicity, a pneumatic load is placed so as to pneumatically load the rear face of the diaphragm, wherein only the beginning of the load tube 24 has been shown.

In alternative embodiments, means for fluidic return/braking (conicities and/or protrusions) and/or for ferrofluid-retaining (flanges) according to the above-described characteristics are utilized on the mandrel 3. It is to be noticed that these fluidic return/braking and/or ferrofluid-retaining means may also be utilized at the upper and lower ends of the edge 28.

Still in the framework of a cone loudspeaker, although, in FIG. 3, the motor comprises only static-magnetic-field generating means in the internal magnetic structure (toward the centre of the loudspeaker), in alternative embodiments, this generating structure may be external with respect to the mandrel or be external to the diaphragm, or in still other embodiments, two coils (or series of coils) may be utilized: one (several) inward with respect to the diaphragm (as shown in FIG. 3), but also one (several) outward with respect to the diaphragm, with the equivalent of a mandrel in place of the edge 28 and one/several static-magnetic-field generating structures so as to create a second air gap on this same side of the diaphragm. In the latter case, it is to be understood that the coils work in phase with each other for a coherent displacement of the diaphragm, which is driven at each of its rims (the outer one through the edge and the inner one through the mandrel).

FIG. 4 will now be described, by way of example of a mixed-type, cone 27'+dome 2', diaphragm loudspeaker. This loudspeaker has a cylindrical symmetry, comprises an internal motor with internal 4 and external 5 magnetic structures, whose design, which may be of any suitable type (with or without iron, with one or two materialized magnetic structures), is not shown in detail herein. In the air gap of this motor is a coil 6 integral with a mandrel 3, itself integral with the cone 27'+dome 2' type diaphragm. Ferrofluid forming a first seal 14 is arranged in the air gap between the outer face of the mandrel and the outer wall of the air gap. The first ferrofluid seal 14 completely fills the air gap, with overflowing, and thus provides, in addition to the guidance function, a pneumatic sealing (however not indispensable in the context of FIG. 4, because the dome is itself leak-tight). The mandrel comprises a conicity-type return/braking means at the two upper (front) and lower (rear) ends of the mandrel 3. It can be noticed that the mandrel 3 is straight in the air gap area (moving unit at rest, at equilibrium) and that the (bilateral) conicity of the mandrel begins at the upper or lower limit of the ferrofluid seal 14. Furthermore, the mandrel 3 comprises at its ends a flange-type ferrofluid-retaining means 13 that is well visible at the lower end of the mandrel. At the upper end, the flange is fastened to the diaphragm and may be optional because the diaphragm may, alone, prevent the ferrofluid from passing on the other side of the mandrel during extreme excursions of the moving unit.

Still in FIG. 4, but on the external periphery side of the cone part 27' of the diaphragm, a ferrofluid guiding means is also utilized in connection with an edge 28' of the diaphragm. A ferrofluid seal 30 is utilized in a guiding structure comprising at least one magnetic-field confining means (or an air gap in the case where the edge comprises a moving coil in another motor, this time an external one, of the loudspeaker). This guiding structure, which may be of the type of the structure (and of the alternative embodiments thereof) utilized in FIG. 3, is not described in more details. As above, the loudspeaker of FIG. 4 may then comprise one motor (external or internal) or two motors. By way of simplification, the other elements of the loudspeaker, as for example the fins between the external and internal parts of the loudspeaker and the associated bowl or the rear pneumatic load, have not been described.

FIG. 5, which is simplified, gives an exemplary embodiment of flange at the lower end of a mandrel 3 (or an edge type 28, 28'). This flange 13 is L-shaped and is slightly inclined so as to make more progressive the fluidic stop effect that, in FIG. 5, has begun to take place, the moving unit being in a position of advanced excursion toward the top (the front of the loudspeaker). The width of the flange is such that it can pass in the air gap (in particular during the motor assembly). The L-shape of the flange 13 is herein utilized in combination with a wall 17 that laterally extends (herein downward, and thus toward the rear of the loudspeaker) the reduced-width part of the free space corresponding to the air gap. There results that the ferrofluid will be forced, on the one hand by the flange 13, but also by this wall 17, to stay on the same side of the mandrel (or of the edge), even during the extreme excursions. This wall 17, shown in dotted lines in FIG. 5, is optional but, when it is present, it improves the effects of ferrofluid-retaining and fluidic stop. It is to be understood that this wall may be an actual piece, added on the ends of the air gap, or a simple lateral extension of the reduced-width part of the vertical free space corresponding to the air gap (this extension having no magnetic function unlike the elements at the air gap). It is to be understood, also in connection with the simplified FIG. 5, that return/braking means (not shown) may be utilized.

It is to be understood that the invention may be adapted in various ways without thereby departing from the general scope of the claims. Thus, a simplified loudspeaker according to the invention preferably comprises a motor with a magnetic-field generator on the outside (with respect to the coil) and with no magnetic-field generator on the inside. The generator preferably comprises a radial magnetic crown formed by a circular juxtaposition of elementary radial magnets (which may possibly lead to the formation of vertical seals if a sufficient quantity of ferrofluid is utilized). More generally, any type of motor may be utilized, a conventional iron motor or an ironless motor, with or without physical looping (through iron or magnets) of the field outside the air gap, one or more unilateral magnetic-field generators (internal or external with respect to the coil) or bilateral generators. The motor, according to all its variants, may also be of the eddy-current type. The field in the air gap may be of any shape and any distribution, for example a substantially uniform field, multiple fields (with alternated directions for an electromagnetic braking effect and/or an operation with several coils). Specific magnetic-field confining means may be utilized or not in the vertical free space where the mandrel moves to facilitate the retaining of ferrofluid in the air gap and said vertical free space. Besides the circular-symmetry motors (with a circular diaphragm), other types of symmetry are possible in the framework of the invention, for example an elliptic symmetry. The transducer may comprise one or two motors according to its type (for example, a cone or mixed loudspeaker may comprise an internal motor and an external motor with respect to the ends of the diaphragm). The return/braking (conicity and protrusions) and retaining/stop (flange) means may be combined into only one structure, that is integrated to or added on the mandrel (or the edge). It has been seen that the retaining of ferrofluid seals was obtained through existence of magnetic fields, both of the air gap and of the specific confining means, and it is then to be understood that the distinction between the both as regard the creation of magnetic fields allowing the retaining of the ferrofluid seals is unnecessary as far as the functional aspect is concerned. Finally, if, preferably, at least one seal is utilized that is spread over the whole height of the air gap (and possibly overflowing therefrom) and also spread over the whole circumference of the mandrel so as to completely fill the air gap on the corresponding side of the mandrel, an alternative may correspond to a series of independent vertical seals spread over the whole height of the air gap (and possibly overflowing therefrom) and distributed (preferably equiangularly) over the circumference of the mandrel, which are substantially parallel to each other. It is to be understood that, in the latter case, if the quantity of ferrofluid for these vertical seals in increased, the ferrofluid will end up completely filling the air gap on the corresponding side of the mandrel, which will allow a sealing to be ensured. Indeed, still in the latter case, this series of independent vertical seals (with the quantity of ferrofluid just necessary for the vertical seals to be independent) does not ensure a pneumatic sealing and, if this sealing is necessary and if it is desired no to increase the quantity of ferrofluid to link the vertical seals together with the ferrofluid, an independent sealing means will be utilized (a circularly continuous seal on the other face of the mandrel or another, more classical, pneumatic sealing means).

The invention claimed is:

1. An electrodynamic transducer (1) with a diaphragm (2), comprising an electrodynamic motor in a frame (7) and in which can move a moving coil (6) fastened to a mandrel (3) integral with the diaphragm, the mandrel and the moving coil and the diaphragm forming a moving unit, the mandrel being a shape generated by a generally linear generatrix, the moving coil being arranged in an air gap of a vertical free space in which it can move and which is delimited, toward the transducer's centre, by an internal magnetic structure (4), and toward the transducer's periphery by an external magnetic structure (5), at least one of the magnetic structures generating a static magnetic field, the transducer comprising no peripheral suspension and no internal suspension, the peripheral suspension being a suspension between the diaphragm's periphery and the frame, the internal suspension being a suspension between the diaphragm or the mandrel and the frame, guidance of the moving unit and pneumatic sealing between the front and rear faces of the diaphragm being provided by a ferrofluid, characterized in that the mandrel is held in the air gap by a ferrofluid spread on at least one of the two faces of the mandrel and said ferrofluid completely fills the air gap over all the corresponding at least one face of the mandrel.

2. A transducer according to claim 1, characterized in that the ferrofluid is spread on only one of the two faces of the mandrel.

3. A transducer according to claim 1, characterized in that the ferrofluid overflows from the two ends of the air gap, so that, during excursions of the mandrel in the air gap, the latter is always filled with ferrofluid on the corresponding at least one face of the mandrel.

4. A transducer according to claim 1, characterized in that it comprises means for fluidic return and braking of the moving unit to an equilibrium position, said fluidic return and braking means generating a preferably progressive diminution of the space in which the ferrofluid can move during excursions of the moving unit out of its equilibrium position, said fluidic return and braking means being chosen from at least one of the following means and the combinations thereof: an upper or lower conicity of the mandrel on the ferrofluid side, at least one upper or lower protrusion pattern of the mandrel on the ferrofluid side, at least one concavity of the mandrel.

5. A transducer according to claim 1, characterized in that it comprises a ferrofluid-retaining means on at least one of the two ends of the mandrel, said ferrofluid-retaining means being a flange for keeping the ferrofluid on the mandrel side, where it is initially located, during excessive excursions of said mandrel.

6. A transducer according to claim 1, characterized in that it comprises at least two magnetic-field confining means (11) in the vertical free space, the confining means being stepped in the vertical free space.

7. A transducer according to claim 1, characterized in that it further comprises at least one non-fluidic return means of the moving unit.

8. A transducer according to claim 7, characterized in that the non-fluidic return means of the moving unit is chosen from one or more of the following means: loading of the diaphragm with a closed volume at the rear the dome, the internal magnetic structure being open toward said closed volume; loading of the diaphragm with a closed volume at the rear the dome, the internal magnetic structure being open toward said closed volume, which comprises a device for controlling the inner pressure, in particular through controlling the temperature of the air contained said the closed volume; loading of the diaphragm with an almost-closed volume at the rear the dome, the internal magnetic structure being open toward said almost-closed volume, said almost-closed volume having a minimal pneumatic leakage, the time constant of which is very long with respect to the frequencies to be reproduced, said leakage being notably in the form of a porous material or a very small diameter orifice or a thin tube toward the outside of the transducer; a mechanical return means of the spring or elastic material type between the dome or the mandrel and a fixed part of the transducer; an electronic feedback control of the coil position; a configuration of the coil and the internal and external magnetic structures such that a return force is electromagnetically exerted onto the coil; a configuration of the moving unit and the internal and external magnetic structures such that a return force is magnetically exerted onto said moving unit.

9. A transducer according to claim 1, characterized in that it is a loudspeaker, the diaphragm is a dome.

10. A transducer according to claim 1, characterized in that it is a loudspeaker, the diaphragm is a cone (27), and in that said diaphragm is located outward the centre of the loudspeaker, a continuous ferrofluid seal (30) being further arranged along the circumference of an edge (28) of the diaphragm, said edge (28) being located along the rim of the diaphragm that is opposed to the rim of the diaphragm in connection with the mandrel (3), said ferrofluid seal (30) being held by at least one magnetic-field confining means (25, 26).

11. A transducer according to claim 10, characterized in that the edge (28) comprises a fluidic retaining and return and braking means, in the form of a curve such that, when the diaphragm is a its rest position, the ferrofluid seal (30) has a maximum space where to position itself with respect to excursions out of the rest position.

12. A transducer according to claim 10, characterized in that the diaphragm comprises a dome-type part and another part of the cone type.

13. A transducer according to claim 1, characterized in that the moving coil is an electrically short-circuited turn and in that at least one of the magnetic structures comprises a fixed coil (20) intended to receive a modulation current, the fixed coil being placed at the air gap in the magnetic structure.

14. A transducer according to claim 13, characterized in that the electrically short-circuited turn type moving coil is integrated to the mandrel, the mandrel being metallic and electrically conductive and forming said electrically short-circuited turn.

15. A transducer according to claim 2, characterized in that the ferrofluid overflows from the two ends of the air gap, so that, during excursions of the mandrel in the air gap, the latter is always filled with ferrofluid on the corresponding at least one face of the mandrel.

16. A transducer according to claim 2, characterized in that it comprises means for fluidic return and braking of the moving unit to an equilibrium position, said fluidic return and braking means generating a preferably progressive diminution of the space in which the ferrofluid can move during excursions of the moving unit out of its equilibrium position, said fluidic return and braking means being chosen from at least one of the following means and the combinations thereof: an upper or lower conicity of the mandrel on the ferrofluid side, at least one upper or lower protrusion pattern of the mandrel on the ferrofluid side, at least one concavity of the mandrel.

17. A transducer according to claim 3, characterized in that it comprises means for fluidic return and braking of the moving unit to an equilibrium position, said fluidic return and braking means generating a preferably progressive diminution of the space in which the ferrofluid can move during excursions of the moving unit out of its equilibrium position, said fluidic return and braking means being chosen from at least one of the following means and the combinations thereof: an upper and/or lower conicity of the mandrel on the ferrofluid side, at least one upper or lower protrusion pattern of the mandrel on the ferrofluid side, at least one concavity of the mandrel.

18. A transducer according to claim 11, characterized in that the diaphragm comprises a dome-type part and another part of cone type.

* * * * *